US005146632A

United States Patent [19]

Li

[11] Patent Number: 5,146,632

[45] Date of Patent: Sep. 15, 1992

[54] LIFTING GATE CONTROL DEVICE FOR A BABY'S CRIB

[76] Inventor: Hsing Li, No. 17, Yung Hsing Street, Taichung, Taiwan

[21] Appl. No.: 804,411

[22] Filed: Dec. 10, 1991

[51] Int. Cl.[5] ..... A47D 7/02

[52] U.S. Cl. ..... 5/100; 292/42; 292/175

[58] Field of Search ..... 5/100, 93.1, 428; 292/175, 42

[56] References Cited

U.S. PATENT DOCUMENTS 3,896,514 7/1975 Feldstein ..... 5/100
4,530,528 7/1985 Shamie ..... 5/100
5,068,932 12/1991 Chang ..... 5/100

*Primary Examiner*—Alexander Grosz

*Attorney, Agent, or Firm*—Bacon & Thomas

[57] ABSTRACT

A lifting gate controlling device for controlling the front lifting gate of a baby's crib, including a mounting bar fastened in either front corner post of a baby's crib, a slide movably mounted on the mounting bar, a lock bolt fastened in the slide and controlled by a compression spring, a movable socket and a retaining block to releasably engage into a slot on the mounting bar, so that when the top rail of the front lifting gate is moved upwardly, this causes the lock bolt to disengage from the slot on the mounting bar, thus permitting the front lifting gate to be moved from an upper limit position to a lower limit position. A slopping track is made on the mounting bar to guide the lock bolt into the slot, when the front lifting gate is moved upwards from its lower limit position, so that the front lifting gate can be locked in its upper limit position.

1 Claim, 7 Drawing Sheets

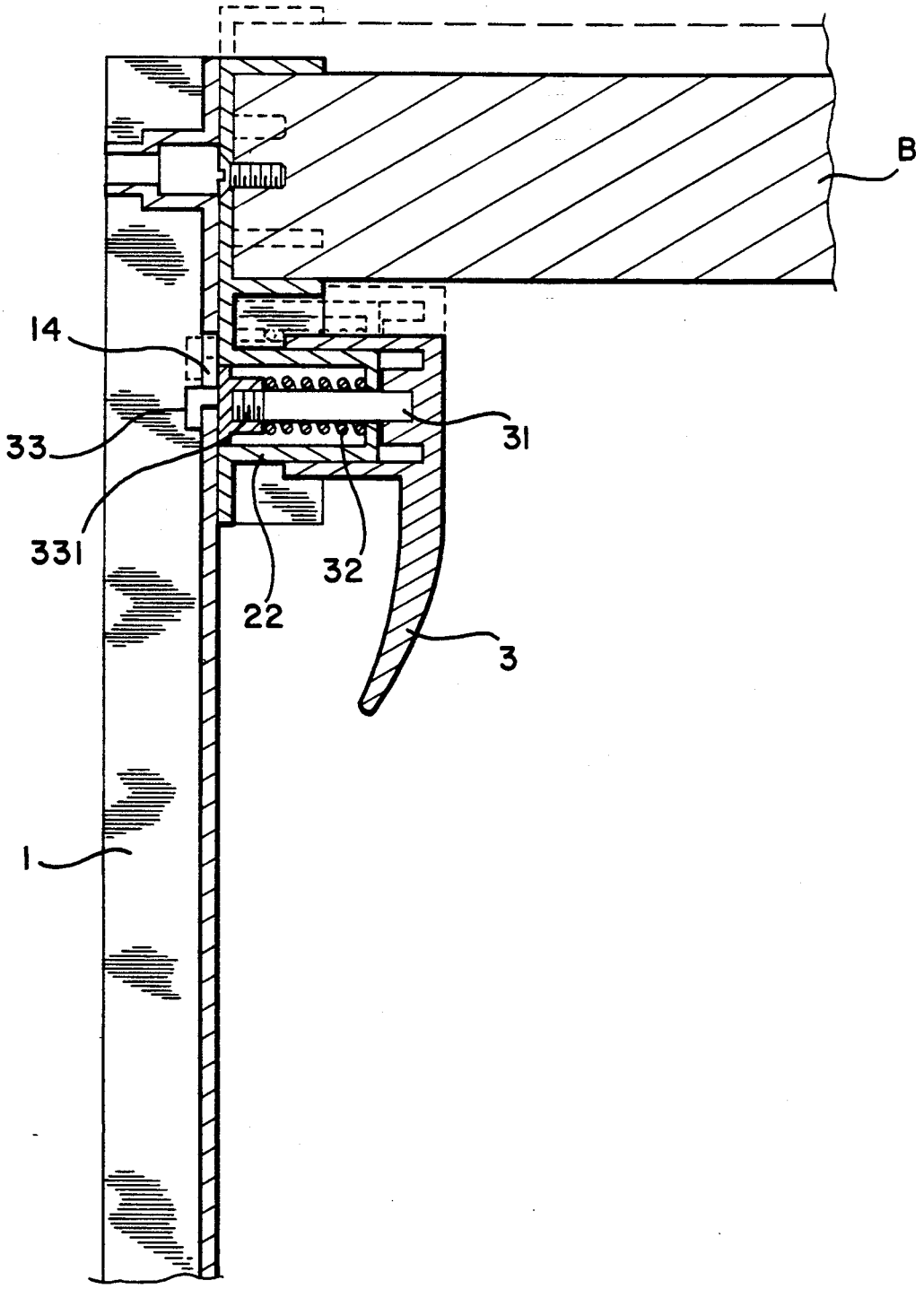
FIG. 1-A
(PRIOR ART)

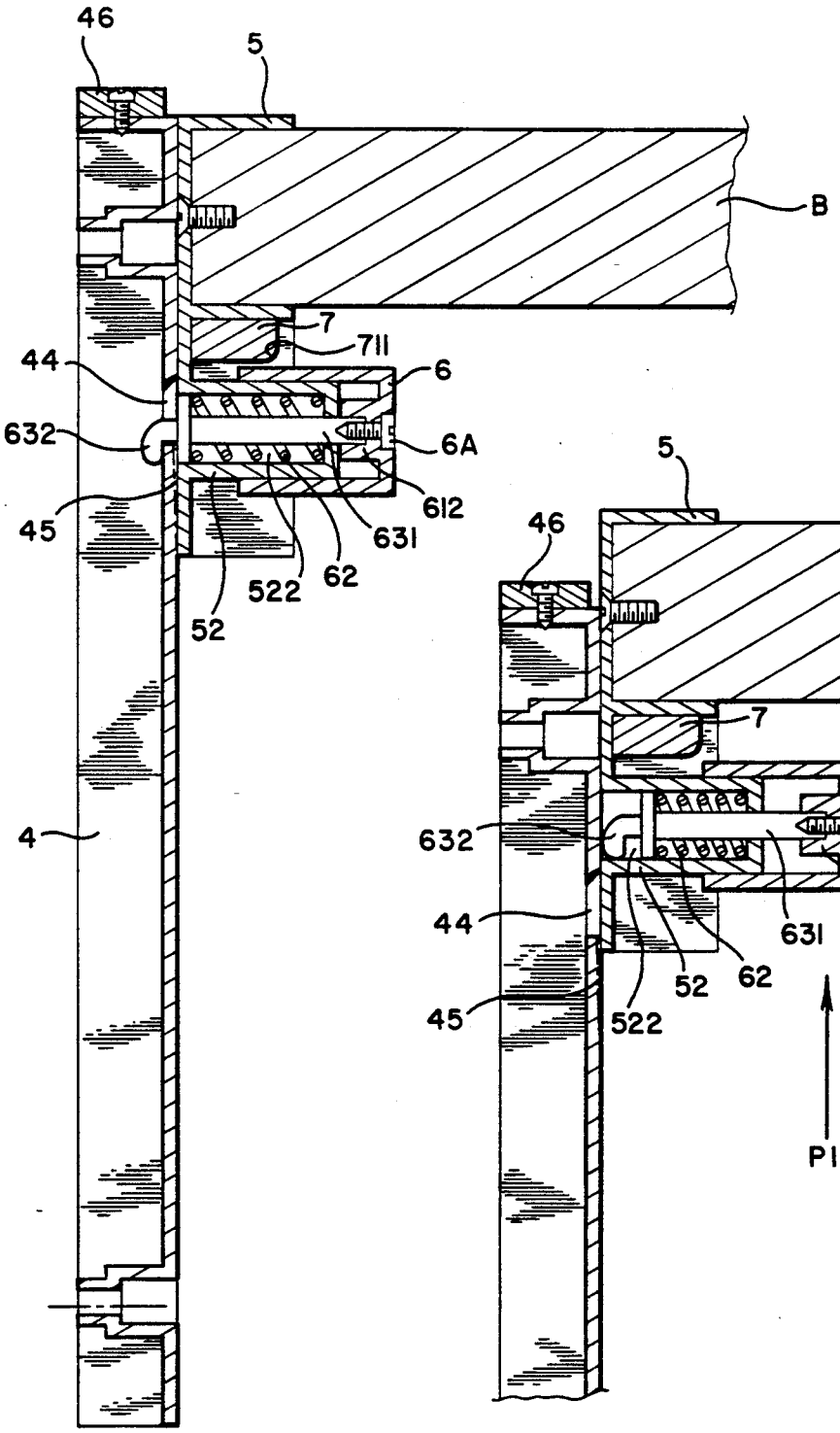
FIG. 3
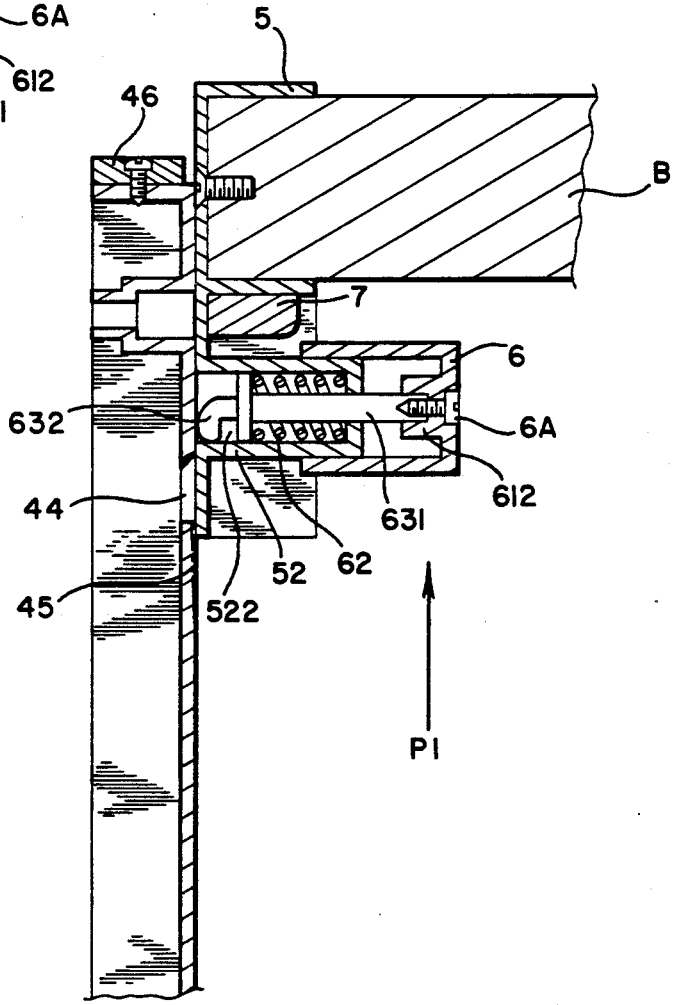
FIG. 3-A

LIFTING GATE CONTROL DEVICE FOR A BABY'S CRIB

BACKGROUND OF THE INVENTION

1. Field of the Invention

The present invention relates to a lifting gate control device and relates more particularly to such a lifting gate controlling device for securing the front lifting gate of a baby's crib in an upper limit position or permitting it to be moved down for putting a baby on the bed plate inside said baby's crib.

2. Description of the Prior Art

A baby's crib is generally comprised of a bed plate with high sides. According to the conventional structure of baby's crib, the high sides are not collapsible. Therefore, putting a baby on the bed plate inside a baby's crib or carrying the baby therefrom is inconvenient. In order to eliminate this problem, there is provided a baby's crib having a front lifting gate secured to two corner posts at one side by two controlling devices which permit the front lifting gate to be moved down for conveniently putting a baby onto the bed plate therein. The lifting gate controlling device, as illustrated in FIGS. 1 and 1-A, is generally comprised of a mounting bar 1 fastened in either corner post on a baby's crib which has two side flanges 11 longitudinally disposed at the two opposite sides of the front face 13 thereof, a slot 14 on the said front face 13 at an upper location and a unitary stop block 12 at the bottom; a slide 2 movably mounted on said front face 13 of said mounting bar 1 which has a fastening hole 21 for holding the top rail B of the front gate of a baby's crib, a circular rod 22 at right angle below said fastening hole 21, which circular rod 22 has a plurality of grooves 221 longitudinally made on the outer wall surface thereof and a through-hole 222 through the central axis thereof, and two inward flanges 231 longitudinally bilaterally disposed at the back with a sliding way 23 defined therein for sliding on said front face 13; a rotary handle 3 fastened in said circular rod 22 to control a L-shaped lock bolt 33, which rotary handle 3 has a plurality of ribs 311 projecting from the inner wall surface thereof and releasably engaged in said grooves 221 on said circular rod 22 and a screw rod 31 inserted into said through-hole 222 and screwed into a bolt hole 331 on said L-shaped lock bolt 33; and a compression spring 32 mounted on said screw rod 31 inside said through-hole 222 and stopped between said handle 3 and said lock bolt 33. During operation to let down the front gate of the baby's crib, the handle 3 is rotated through 90° angle and pulled outwards so as to disconnect the L-shaped lock bolt 33 permitting the front gate of the baby's crib to be let down with the top rail B stopped at the stop block 12 of the mounting bar 1 (as shown in FIG. 1-A). Because two lifting gate controlling devices must be symmetrically mounted on the two corner posts at the front of a baby's crib to simultaneously hold the top rail B of the front gate, the two handles 3 of the two lifting gate controlling devices must be simultaneously rotated and pulled outwards (namely, toward each other) so that the two L-shaped lock bolts 33 of the two lifting gate controlling devices can be disengaged from the slots 14 on the two mounting bars 1. When one has a baby on one's arms, it is difficult to simultaneously operate the two lifting gate controlling devices. Because much effort is required to rotate the handle 3 of each lifting gate controlling device and pull it outwardly, the baby crib may be shaken and caused to displace during the operation. Therefore, a baby's crib shall be stopped at a corner area inside a building. Further, the L-shaped lock bolt 33 may be moved to engage into the slot 14 easily when the slide 2 is moved downwards from the top above the slot 14 after the L-shaped lock bolt 33 having been disengaged from the slot 14.

SUMMARY OF THE INVENTION

The present invention has been accomplished to eliminate the aforesaid problems. According to one aspect of the present invention, there is provided a lifting gate controlling device for controlling the front lifting gate of a baby's crib, which is generally comprised of a mounting bar fastened in either front corner post of a baby's crib which has a sliding surface, a slot on said sliding surface at an upper location, an elongated, sloping track longitudinally extending downwards from said slot, and a unitary stop block at the bottom; a slide movably mounted on said sliding surface of said mounting bar which has a fastening for holding the top rail of said baby's crib, and a circular rod at right angle below said fastening hole, which circular rod has a through-hole through the central axis thereof; a lock bolt fastened in the through-hole on said circular rod by a movable socket to secure said slide to said mounting bar, which lock bolt has a bolt hole at one end inserted into the through-hole on said circular rod and secured to said movable socket by a screw and a hooked portion at an opposite end engaged into the slot on said mounting bar; a compression spring mounted on said lock bolt and retained between said movable socket and said lock bolt; and a retaining block mounted on said slide and retained between said fastening hole and said circular rod which has a front projection and a sloping edge on said front projecting at the bottom. Because of the arrangement of the retaining block, the lock bolt can be conveniently moved by the movable socket from the slot on the mounting bar into the through-hole on the circular rod so that the front lifting gate of the baby's crib can be let down. Further, because of the arrangement of the sliding track on the mounting bar, the lock bolt can be conveniently guided into the slot, when the front lifting gate is moved upwards from its lower limit position, so that the front lifting gate of the baby's crib can be locked in its upper limit position.

BRIEF DESCRIPTION OF THE DRAWINGS

The foregoing and other objects, features and advantages of the present invention will be best understood from the following description, the appended claims and the accompanying drawings in which:

FIG. 1-A is a sectional assembly view of the prior art lifting gate controlling device;

FIG. 3 is a sectional assembly view of the lifting gate controlling device of the present invention;

FIG. 3-A is a sectional view of the present invention showing that an upward force is applied at the top rail to move the lock bolt away from the slot on the mounting bar;

DETAILED DESCRIPTION OF THE PREFERRED EMBODIMENT

Figure 1:
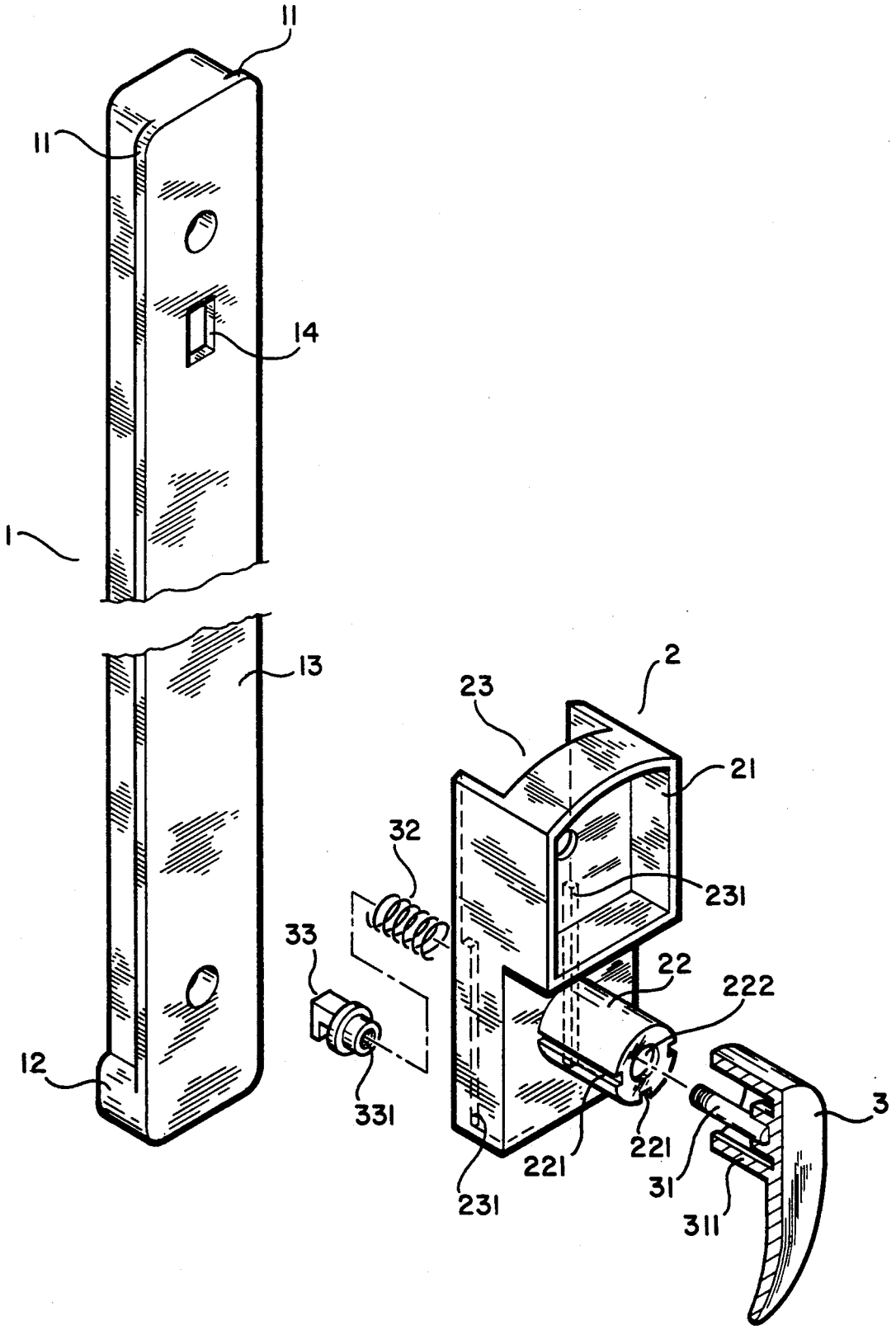
FIG. 1 (PRIOR ART)
FIG. 1 is an exploded perspective view of a prior art lifting gate controlling device.
Figure 2:
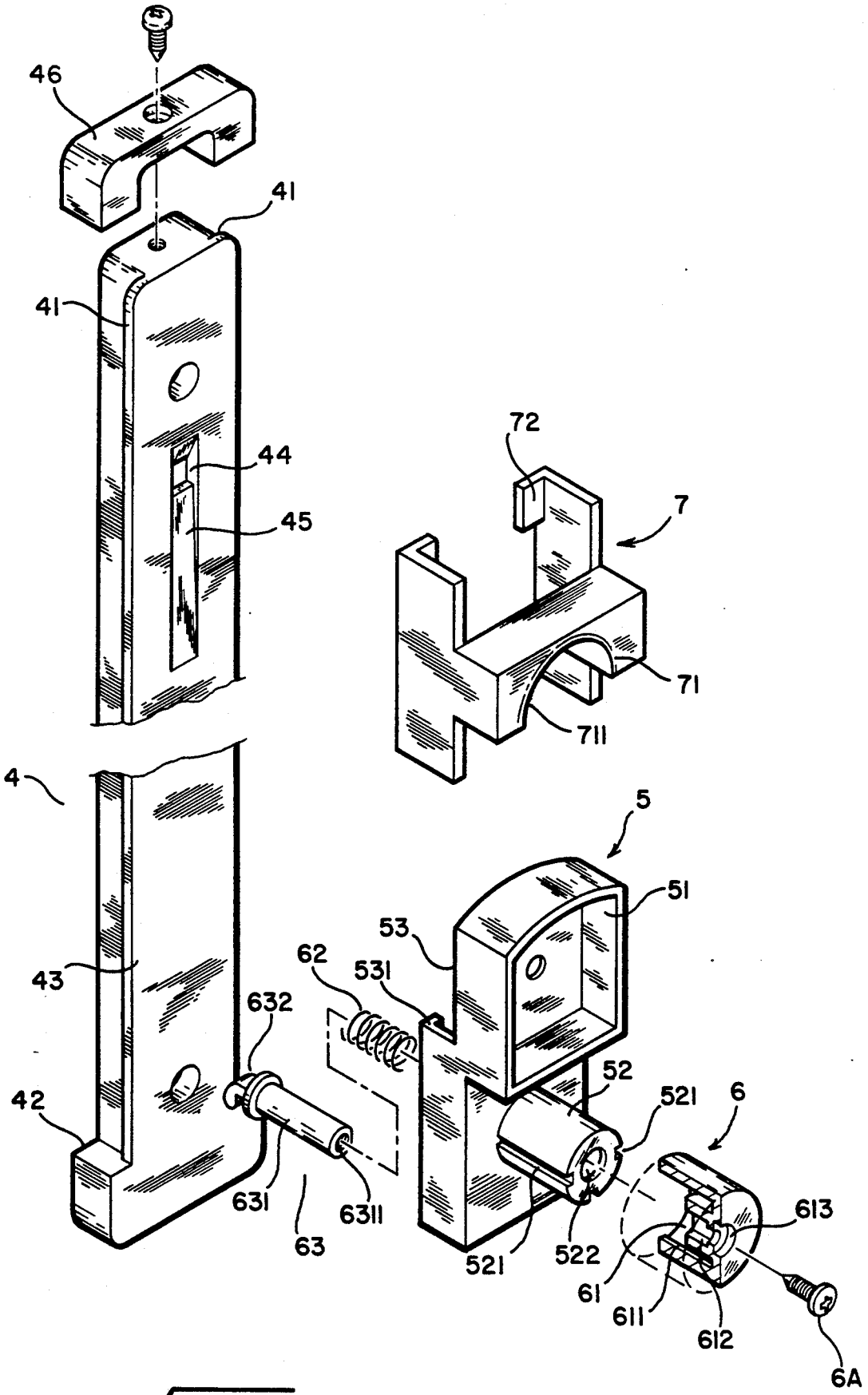
FIG. 2 is an exploded perspective view of the preferred embodiment of the lifting gate controlling device of the present invention.

Referring to FIG. 2, therein illustrated is the preferred embodiment of the lifting gate controlling device of the present invention which is generally comprised of a mounting bar 4, a slide 5, a retaining block 7, a lock bolt 63, a compression spring 62, and a movable socket 6. The mounting bar 4 which is to be directly fastened in either corner post A at the front side of a baby's crib has a front face 43, two opposite side flanges 41 longitudinally bilaterally disposed at the two opposite sides of said front face 43, a slot 44 on said front face 43 at an upper location, an elongated sliding track 45 longitudinally disposed on said front face 43 below said slot 44, a unitary stop block 42 at the bottom, and an U-shaped locating plate 46 attached thereto at the top. The slide 5 which is mounted on the mounting bar 4 and moved to slide along the side flanges 41 has a fastening hole 51 for holding the top rail B of the front gate (namely, the front high side) of a baby's crib, a circular rod 52 at right angle below said fastening hole 51, which circular rod 52 has a plurality of grooves 521 longitudinally made on the outer wall surface thereof and a through-hole 522 through the central axis thereof, a sliding way 53 on the back wall surface thereof, and two inward flanges 531 longitudinally bilaterally disposed at the back. The lock bolt 63 which is inserted into the through-hole 522 on the circular rod 52 of the slide 5 from the back comprises a body 631 having a bolt hole 6311 on the front end thereof and a hooked portion 632 at the rear end thereof. The movable socket 6 defines therein a receiving chamber 61, and has a plurality of ribs 611 on the inner wall surface thereof around said receiving chamber 61, a center hole 612 longitudinally disposed at the center and a bolt hole 613 longitudinally aligned with said center hole 612 at the back. During installation, the compression spring 62 is sleeved on the body 631 of lock bolt 63 before the insertion of the lock bolt 63 into the through-hole 522 on the circular rod 52. As soon as the lock bolt 63 is inserted into the through-hole 522, the movable socket 6 is mounted on the circular rod 52 with the body 631 of the lock bolt 63 received in the center hole 612 inside the receiving chamber 61. Therefore, fastening a screw 6A through the bolt hole 613 on the movable socket 6 into the bolt hole 6311 on the body 631 of the lock bolt 63, the lock bolt 63 and the movable socket 6 are secured to the slide 5 with the compression spring 62 firmly squeezed in between the hooked portion 632 of the lock bolt 63 and the back wall surface of the slide 5. The retaining block 7 comprises two inward flanges 72 longitudinally bilaterally disposed at the back by which it is mounted on the slide 5 between the fastening hole 51 and the circular rod 52, and a front projection 71 at the front which has a circular sloping edge 711 at the middle.

Figure 4:
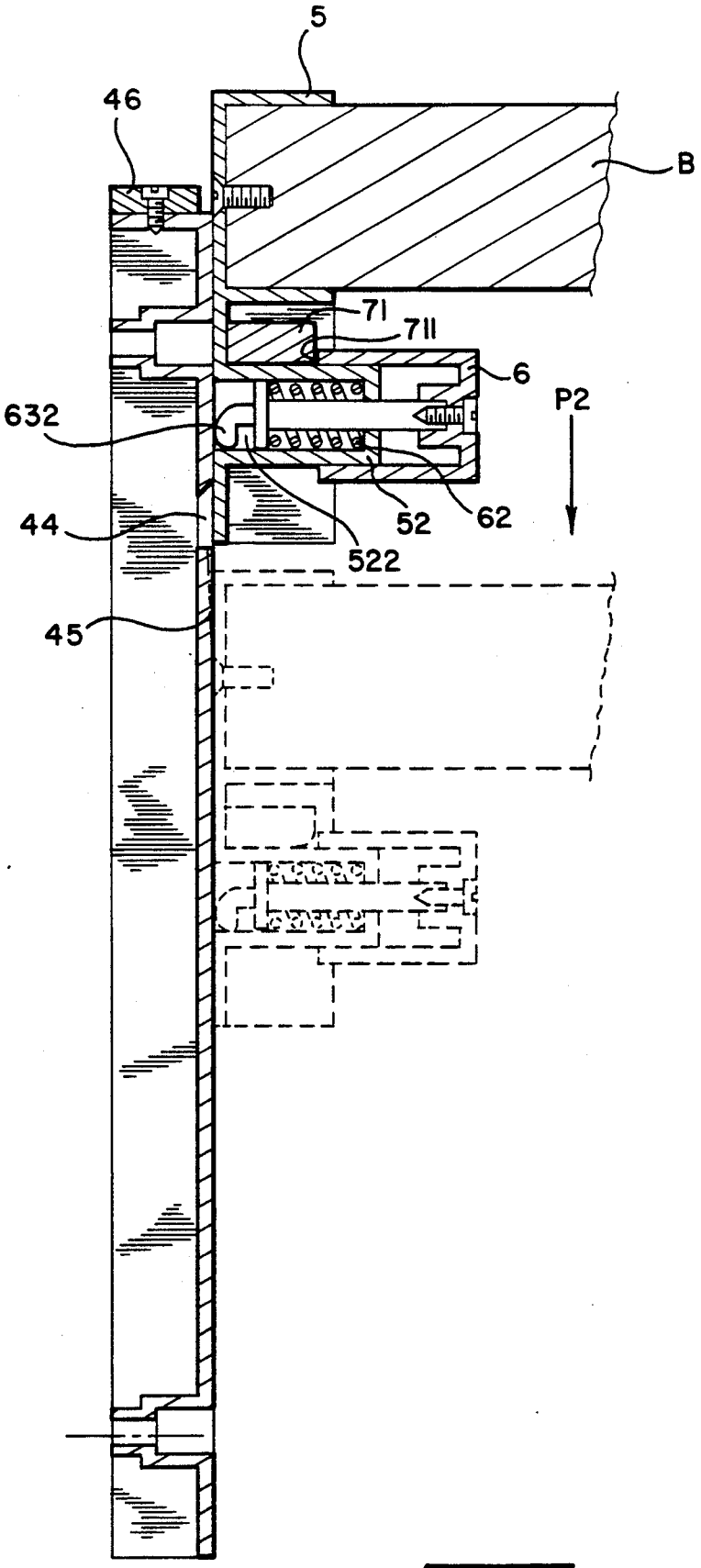
FIG. 4 is another sectional view of the present invention showing that the lock bolt has been received inside the through-hole on the circular rod and the top rail of the front gate of the baby's crib is permitted to move downwards.
Figure 5:
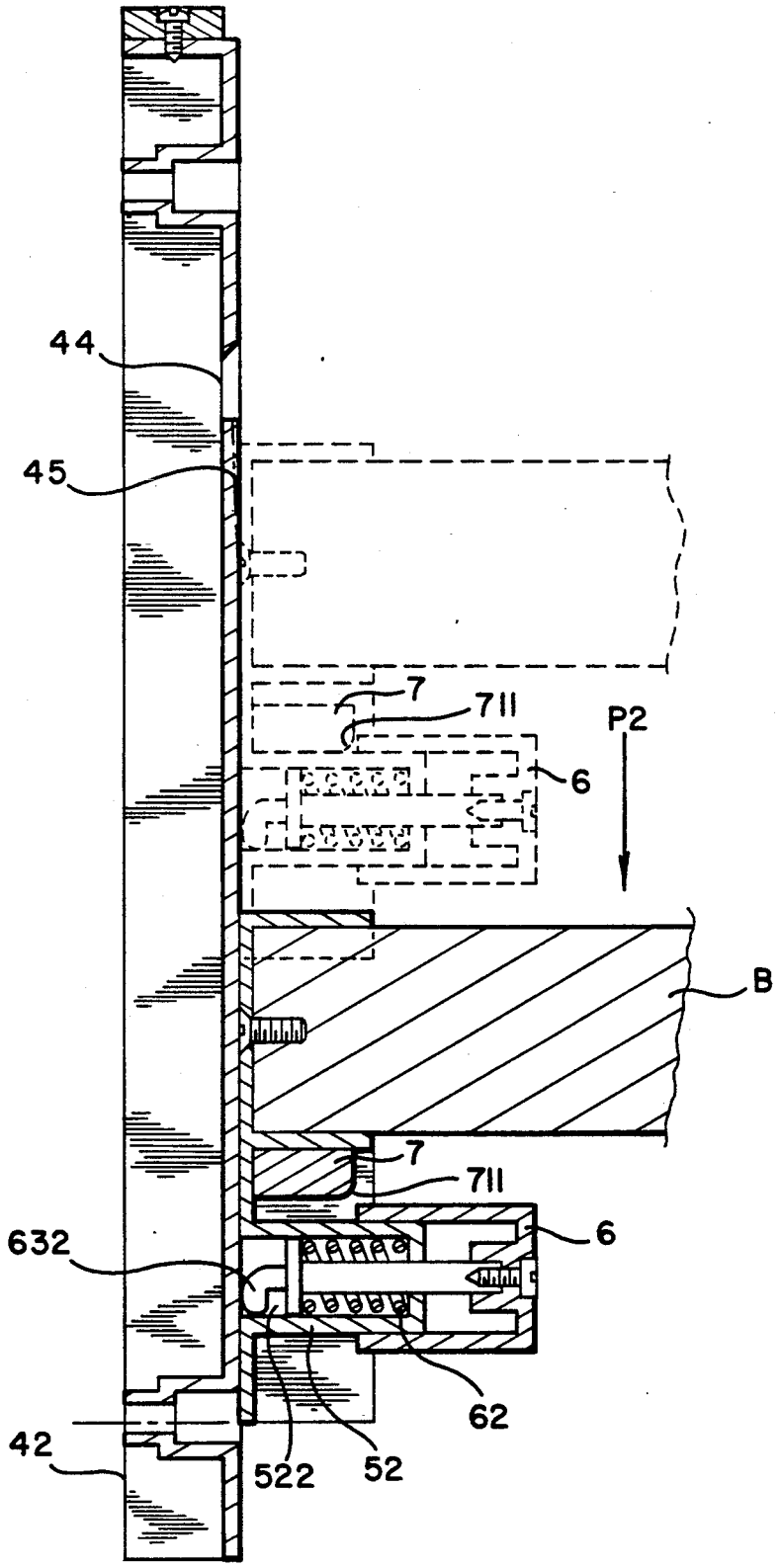
FIG. 5 is still another sectional view of the present invention showing that the top rail of the front gate of the baby's crib has been moved to the lower limit position stopped at the stop block of the mounting bar.
Figure 6:
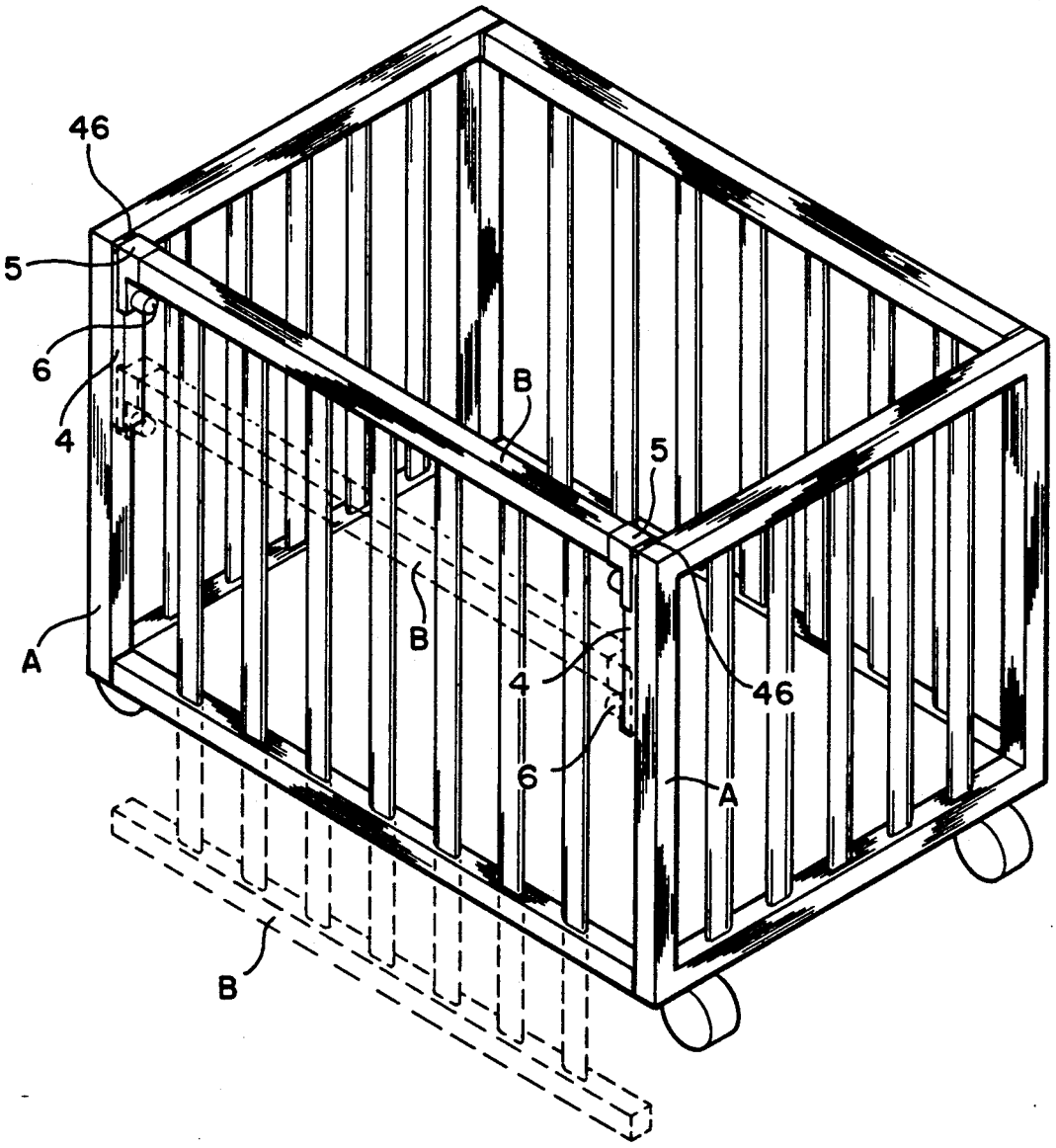
FIG. 6 illustrates a baby's crib as constructed according to the present invention.

When in use, two lifting gate controlling devices shall be symmetrically fastened in the two opposite corner posts A at the front side of a baby's crib to hold the top rail B of the front gate (namely, the front high side) of the baby's crib (see FIG. 6). As shown in FIGS. 3, 3-A, 4, 5 and 6, the front gate of the baby's crib can be conveniently lowered so that a baby can be put on the bed plate inside the baby's crib. Applying an upward pressure P1 to the top rail B at the middle (as shown in FIG. 3-A) causes the slide 5, the movable socket 6 and the retaining block 7 to be simultaneously carried upwards, and at the same time, the hooked portion 632 of the lock bolt 63 is squeezed against the front face 43 of the mounting bar 4. Because of the effect of the compression spring 62, the lock bolt 63 can be conveniently moved out of the slot 44. As soon as the retaining block 7 is stopped at the locating plate 46, the movable socket 6 is moved through the circular sloping edge 711 and stopped against the front projection 71 of the retaining block 7, causing the hooked portion 632 of the lock bolt 63 to move into the through-hole 522 on the circular rod 52. Therefore, the slide 5 can be continuously moved upward (see FIG. 4). As soon as the lock bolt 63 is disconnected from the mounting bar 4, the top rail B is released from the corner post A, and therefore, the front gate (the front high side) of the baby's crib can be let down (see FIGS. 4 and 5). Because the lock bolt 63 is completely received inside the through-hole 522 on the circular rod 52, the slide 5 can be smoothly moved downwards through the slot 44 so as to let down the top rail B. As soon as the retaining block 7 is stopped at the stop block 42, the downward pressure P2 of the gravity of the top rail B of the front gate of the baby's crib immediately forces the movable socket 6 to move away from the front projection 71 through the circular sloping edge 711 and return to its original position with its ribs 611 respectively engaged into the grooves 521 on the circular rod 52 (see FIG. 5).

Moving the front gate of the baby's crib is quite easy. When the top rail B is moved upwards, the slide 5, the movable socket 6 and the retaining block 7 are simultaneously carried upwards. While moving upwards, the hooked portion 632 of the lock bolt 6 will be guided by the sliding track 45 into the slot 44 to lock the top rail B in position.

I claim:

1. A lifting gate controlling device for securing the front face of a baby's crib permitting it to be fixed in position or moved down, the improvement comprising:

a mounting bar fastened in a corner post on a baby's crib, said mounting bar comprising sliding surface, a slot on said sliding surface at an upper location, an elongated, sloping track longitudinally extending downwards from said slot, and a unitary stop block at the bottom;

a slide movably mounted on said sliding surface of said mounting bar, said slide comprising a fastening hole for holding the top rail of said baby's crib, and a circular rod at right angle below said fastening hole, said circular rod having a through-hole through the central axis thereof;

a lock bolt fastened in said through-hole on said circular rod by a movable socket to secure said slide to said mounting bar, said lock bolt having a bolt hole at one end inserted into said through-hole and secured to said movable socket by a screw and a hooked portion at an opposite end engaged into said slot on said mounting bar;

a compression spring mounted on said lock bolt and squeezed between the front end of said circular rod and the hooked portion of said lock bolt;

a retaining block mounted on said slide and retained between said fastening hole and said circular rod, said retaining block having a front projection and a sloping edge on said front projecting at the bottom; and wherein moving said top rail upwards causes said lock bolt to be pulled into said through-hole on said circular rod by said movable socket and disengaged from said slot on said mounting bar so that the front gate of said baby's crib can be moved from an upper limit position to a lower limit position; moving the front gate of said baby's crib from said lower limit position upwards causes said lock bolt to be moved along said sloping track and engaged into said slot on said mounting bar to lock the front gate of said baby's crib in an upper limit position.

* * * * *